United States Patent [19]

Schubach

[11] 4,062,161

[45] Dec. 13, 1977

[54] STRIP FOR RETAINING TWO EXTRUSIONS IN SELECTED POSITION

[75] Inventor: Theodor C. Schubach, Powell, Ohio

[73] Assignee: Rohr Industries, Inc., Chula Vista, Calif.

[21] Appl. No.: 673,399

[22] Filed: Apr. 5, 1976

[51] Int. Cl.[2] ..... E04C 1/34; E04B 1/62

[52] U.S. Cl. ..... 52/461; 52/403; 52/468; 52/500; 52/506

[58] Field of Search ..... 52/506, 460, 461, 403, 52/468, 500, 335, 278, 395, 396; 292/92

[56] References Cited

U.S. PATENT DOCUMENTS

| | | | |
|---|---|---|---|
| 3,199,258 | 8/1965 | Jentoft et al. | 52/395 |
| 3,339,329 | 9/1967 | Berg | 52/460 |
| 3,435,574 | 4/1969 | Hallock | 52/395 |
| 3,488,828 | 1/1970 | Gallagher | 52/395 |
| 3,508,369 | 4/1970 | Tennison | 52/403 |
| 3,696,575 | 10/1972 | Armstrong | 52/395 |
| 3,732,659 | 5/1973 | LaBarge | 52/461 |
| 3,760,544 | 9/1973 | Hawes et al. | 52/468 |

*Primary Examiner*—Price C. Faw, Jr.
*Assistant Examiner*—Robert C. Farber
*Attorney, Agent, or Firm*—Patrick J. Schlesinger

[57] ABSTRACT

The head portion of a T-shape strip of elastomeric material is threaded lengthwise into the undercut sides of a channel formed in one of two members to be joined together so that the stem or body portion of the strip projects therefrom. The strip is so located, and this projecting stem portion is of such thickness, as to enter a narrow channel with serrated sides formed in the other of said members. Supported as on a fulcrum on a narrow neck portion projecting from the free edge of the strip stem portion, and spaced slightly from the stem portion, is a transversely curved portion which is slightly wider than the serrated channel. Upon movement of the two members toward each other, the stem portion forces the transversely curved portion to flex, and enter into the serrated channel, in which position the edges of the curved portion are in gripping relation with the channel serrations, and thus resist its withdrawal.

5 Claims, 5 Drawing Figures

STRIP FOR RETAINING TWO EXTRUSIONS IN SELECTED POSITION

BACKGROUND OF THE INVENTION

In the manufacture of transit vehicles, such as buses and rail cars, a recent and growing practice is to make the vehicle side walls, or at least portions thereof, of panels assembled from aluminum strakes extruded to exact dimensions. Embodied in these side walls may be various snap-on elements, which are applied after portions of the vehicle have been assembled, for example, extruded strips to cover the intersections of the side walls and roof or floor, or a plate or strip to cover an access area after the manufacturing procedures requiring access thereto have been completed. The prior art abounds with various types of snap-on fasteners, for example, as shown in U.S. Pat. Nos. 1,487,855, 3,120,971, 3,339,329, 3,508,369, 3,667,177, 3,732,659, and 3,760,544. While some of these prior patents may be usable to some extent for the purpose of the present invention, the latter has important structural and other features and advantages which distinguish if from any and all known prior art.

FEATURES OF THE INVENTION

The invention comprises essentially the combination with two extruded aluminum members mounted in selected spaced, opposed relation, of a strip of material of uniform thickness with one edge thereof attached to the opposed side of one of the members so as to project substantially perpendicularly therefrom. The strip is of thickness, and is so positioned, as to enter a channel of substantially corresponding width, preferably with rough or serrated walls, formed in the opposed side of the other of said members when the members are moved toward contact with each other. The other edge of the strip has a narrow neck projecting therefrom, and supported on this neck portion as on a fulcrum, with its sides spaced from the stem portion to permit flexing, is a transversely disposed strip portion of a width slightly greater than the width of the serrated channel. When the two opposed extrusions are moved with selected force toward each other, the projecting stem portion forces the transverse strip portion to flex and enter into the serrated channel, in which position the side edges of the transverse strip portion grip the sides of the serrated channel and thereby restrain the two extrusions against separation.

BRIEF DESCRIPTION OF THE DRAWINGS

Objectives and advantages of the invention will be apparent from the following description and the accompanying drawings wherein.

DETAILED DESCRIPTION OF THE ILLUSTRATIVE FORM OF THE INVENTION

Figure 1:
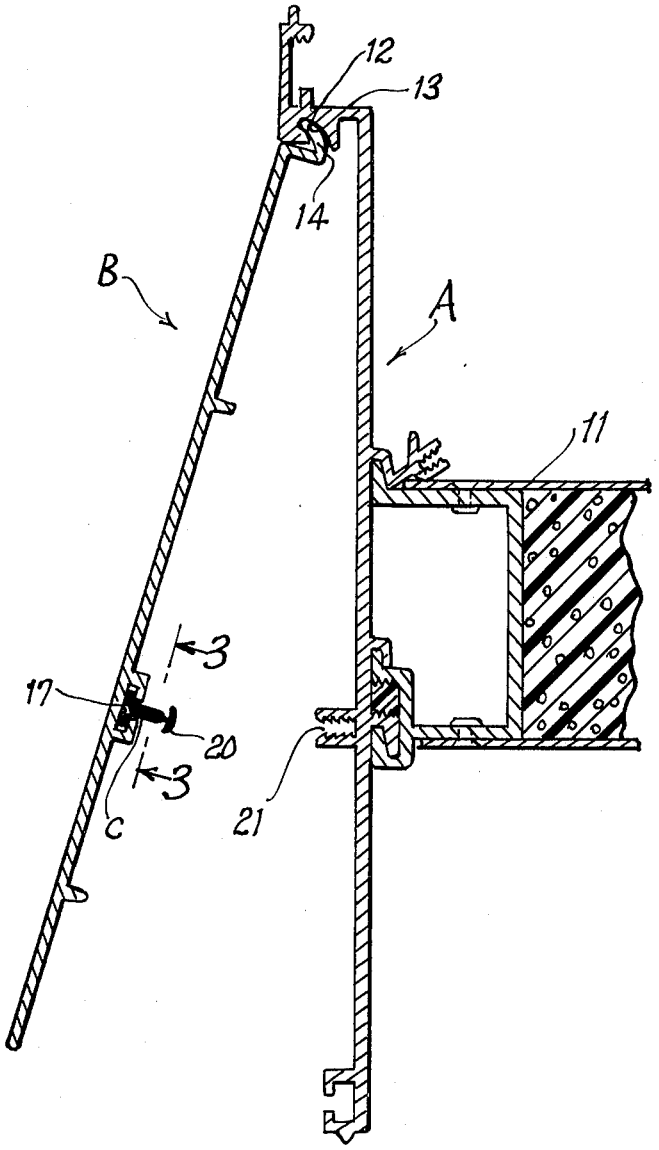
FIG. 1 is a transverse, sectional view of two elongated, hingedly connected, aluminum extrusions embodying the invention, a fragment of the vehicle floor also being shown, the lower edge of one of the extrusions being swung outwardly away from the other.
Figure 2:
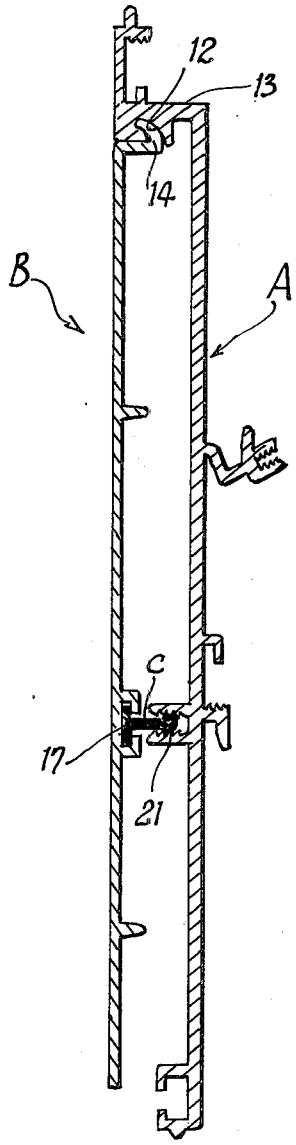
FIG. 2 is a view similar to FIG. 1, with said one extrusion swung inwardly toward the other, and retained against separation therefrom by the present invention, the floor fragment being omitted.

Referring to the drawings in detail, FIGS. 1 and 2 show, in cross section, an extruded aluminum strake A comprising a part of the lower side wall structure of a bus or rail car, not otherwise shown, in the zone of its connection to the vehicle floor 11, see FIG. 1. A curved hinge slot 12 is provided in an offset 13 located near the upper edge of the strake A, to receive a similarly shaped hinge tongue 14 formed along the upper edge of an extruded cover plate B to provide limited, detachable hinge support for the cover plate. This hinge connection allows the cover plate B to be swung between its released, open position of FIG. 1, and its closed, attached position of FIG. 2.

Figure 4:
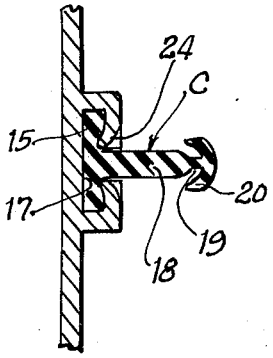
FIG. 4 is a sectional view taken along line 4—4 of FIG. 3.

For retaining the cover plate B in its closed position of FIG. 2, an attaching strip C, of "T" cross sectional shape, has its head portion 15 threadedly inserted in a channel 17, with undercut side walls, formed integrally with the cover plate B, and the stem or body portion 18 of the strip C projecting substantially perpendicularly therefrom. Along the free edge of the stem portion 18 extends a narrow neck portion 19, see FIG. 4, which supports a transversely curved, externally convex strip portion 20, of a width slightly greater than the thickness of the stem portion 18. The neck portion 19 supports the curved strip portion 20 as on a fulcrum with sufficient clearance from the stem portion 18 to allow limited laterally inward flexing of the side edges of the transversely curved strip portion 20.

Figure 5:
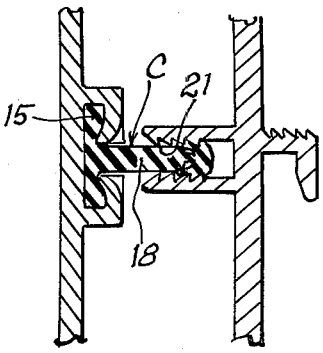
FIG. 5 is an enlarged, fragmentary, sectional view showing the transversely curved strip portion gripping the serrated channel sides to resist withdrawal.

A narrow channel 21, with serrated side walls, is formed integrally with the strake A. This serrated wall channel 12 is of a width to receive the strip stem portion 18 therein, but is narrower than the transverse strip portion 20. The serrated wall channel 21 is aligned with the projecting strip stem portion 18, with its open side facing the stem portion. Thus, when the cover plate B is swung from its open position of FIG. 1, to its closed position of FIG. 2, the strip stem portion 18 forces the curved, transverse strip portion 20 to flex and enter into the serrated wall channel 21 as shown in FIGS. 2 and 5.

Once inserted in the serrated wall channel 21, the resiliency of the curved, transverse strip portion 20, however slight, urges the sides thereof toward pressure engagement with serrations in the side walls of the channel 21. Any attempt made to withdraw the curved strip portion 20 from the channel 21 tends to straighten out the curved strip portion 20 and thus increase its width, thereby urging it even more forcibly into the channel serrations and increasing its resistance to withdrawal.

Figure 3:
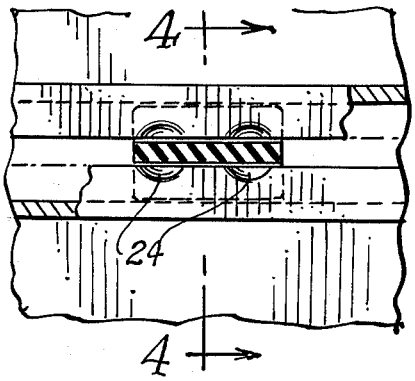
FIG. 3 is an enlarged, fragmentary, sectional view taken along line 3—3 of FIG. 1, showing a short length of the retaining strip staked in position to prevent endwise displacement thereof.

The strength of the retaining means of the present invention is simply and easily controlled, either by varying the strength and stiffness of the curved strip portion 20, or the total length of retaining strip C employed. For example, if it is desired to be able to manually separate two members attached in adjacent relation by mechanism embodying the invention, the material employed for making the retaining strip, or at least the transverse portion 20 thereof, may be of softly resilient material, and may comprise but one, or at most only a small number of short lengths, for example, of the length shown in FIG. 3. In such case the short retaining strips employed preferably are staked in position by deforming the overlying channel sides into pressure engagement with the strip head portion 15 by means of a conventional staking tool or punch to the condition shown at 24 in FIGS. 3–5.

If greater holding power is required, the strip C employed may be of firmer material, or may comprise strip material of greater length, or a larger number of strips, to a point wherein the attaching means is of such strength as to require destruction of at least one of the attached numbers in order to effect separation. Also, the entire strip C, or at least a selected part thereof, such as, for example, the curved strip portion 20, may be formed of, or reinforced by, a suitable metal if maximum holding strength is required. With these suggestions such modifications will be readily apparent to one of ordinary skill in the industry, and further details thereof are, therefore, omitted.

The invention provides simple, relatively inexpensive, and highly adaptable attaching mechanism, and while its primary intended use, and the reason for its development, is on transit vehicles, such as buses and rail cars, it obviously has many other potential applications which will occur to an ordinarily skilled worker when faced with the need for attaching mechanism of this general character.

Having thus described what is new and useful and desired to be secured by United States Letters Patents, I claim:

1. Mechanism for attaching a first member to a second member comprising:

a pair of substantially rigid walls integrally formed on the second member defining a first channel therebetween, said channel having a serrated interior surface;

a T-shaped attaching strip of substantially resilient material having a head portion at one end and a stem portion extending perpendicularly from said head portion, said stem portion having a relieved area to form a narrow neck portion at its other end with a transversely disposed portion mounted on the end of said neck portion;

said stem portion being of a width substantially corresponding to the width of said channel;

said first member having a pair of normally extending parallel wall members integrally formed along one of its sides to define a second channel for receiving the head portion therein;

a flange on the free end of each wall member overlying the head portion within the second channel to retain the attaching strip therewithin;

said transversely disposed portion being of a width slightly greater than the thickness of said stem portion and said first channel whereby when the first and second members are moved with predetermined force toward each other, the projecting stem portion enters into said serrated channel, in which position the side edges of the transverse strip portion grip the sides of the serrated channel and thereby restrain said first and second members against separation;

the sides of said transverse strip portion being compressed into the relieved area of said narrow neck portion during insertion of said transverse strip portion into said serrated channel.

2. Mechanism as recited in claim 1 wherein said T-shaped attaching strip is staked in position by deformation said overlying flanges into pressure engagement with the strip head portion.

3. Mechanism as recited in claim 1, wherein the transversely disposed portion is transversely curved, with the convex side thereof facing outwardly relative to the strip head portion.

4. Mechanism as recited in claim 1, wherein the transversely disposed portion is centered on the neck portion.

5. Mechanism as recited in claim 1, wherein the first and second members are hingedly interconnected.

* * * * *